US007002527B2

(12) United States Patent
Sugawara

(10) Patent No.: US 7,002,527 B2
(45) Date of Patent: Feb. 21, 2006

(54) VARIABLE-DIRECTIVITY ANTENNA AND METHOD FOR CONTROLLING ANTENNA DIRECTIVITY

(75) Inventor: Satoru Sugawara, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/803,072

(22) Filed: Mar. 17, 2004

(65) Prior Publication Data

US 2004/0246192 A1 Dec. 9, 2004

(30) Foreign Application Priority Data

Mar. 20, 2003 (JP) ..... 2003-076953
Mar. 16, 2004 (JP) ..... 2004-073701

(51) Int. Cl.
*H01Q 9/00* (2006.01)

(52) U.S. Cl. ..... 343/750; 343/752

(58) Field of Classification Search ..... 343/773, 343/850, 845, 750, 752
See application file for complete search history.

(56) References Cited

U.S. PATENT DOCUMENTS

| | | | | |
|---|---|---|---|---|
| 4,074,268 A | | 2/1978 | Olson | 343/106 R |
| 4,338,606 A | * | 7/1982 | Tada et al. | 343/744 |
| 5,357,123 A | | 10/1994 | Sugawara | 257/88 |
| 5,767,807 A | | 6/1998 | Pritchett | 342/374 |
| 5,796,369 A | * | 8/1998 | Henf | 343/752 |
| 6,008,770 A | | 12/1999 | Sugawara | 343/767 |
| 6,049,310 A | * | 4/2000 | Sadahiro | 343/702 |
| 6,075,493 A | | 6/2000 | Sugawara et al. | 343/767 |
| 6,219,001 B1 | | 4/2001 | Sugawara et al. | 343/767 |
| 6,407,719 B1 | | 6/2002 | Ohira et al. | 343/893 |
| 6,411,175 B1 | | 6/2002 | Sugawara et al. | 333/127 |
| 2001/0019531 A1 | | 9/2001 | Sugawara | 369/121 |
| 2002/0154591 A1 | | 10/2002 | Sugawara | 369/112.27 |
| 2003/0053501 A1 | | 3/2003 | Sekiya et al. | 372/43 |

FOREIGN PATENT DOCUMENTS

| | | |
|---|---|---|
| DE | 4421759 C1 | 4/1995 |
| EP | 0812026 A | 12/1997 |
| EP | 1113523 A | 7/2001 |
| JP | 1126001 A | 5/1989 |
| JP | 6-350334 | 12/1994 |
| JP | 10-154911 | 6/1998 |
| JP | 2001-24431 | 1/2001 |

* cited by examiner

*Primary Examiner*—Hoang V. Nguyen
(74) *Attorney, Agent, or Firm*—Cooper & Dunham LLP

(57) ABSTRACT

A variable-directivity antenna comprises an omnidirectional antenna element, a transmission line connected to the antenna element, and an electric field adjusting structure provided in a boundary region between the antenna element and the transmission line. The electric field adjusting structure is configured to change electric field distribution of the transmission line to a desired direction.

21 Claims, 10 Drawing Sheets

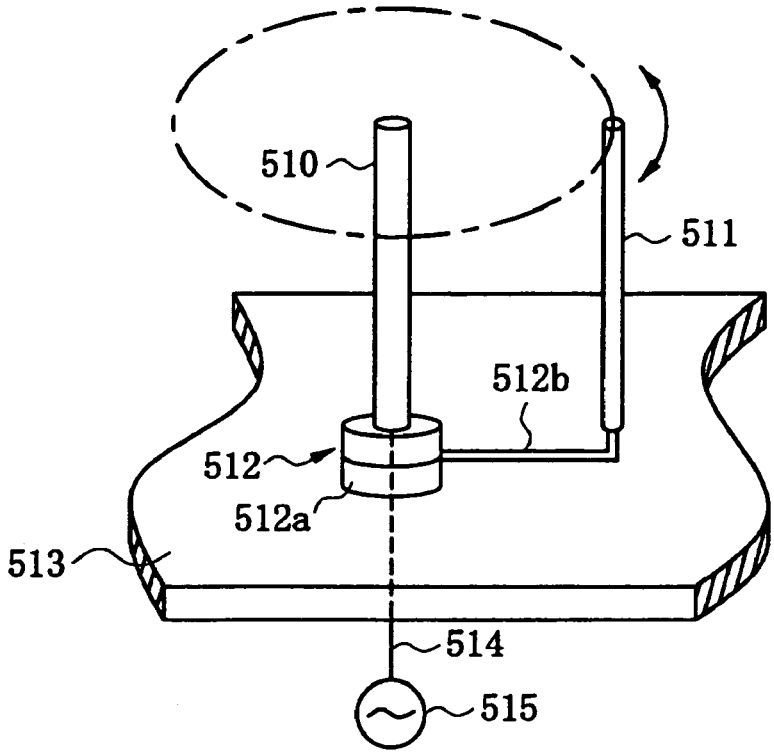
FIG.1B PRIOR ART
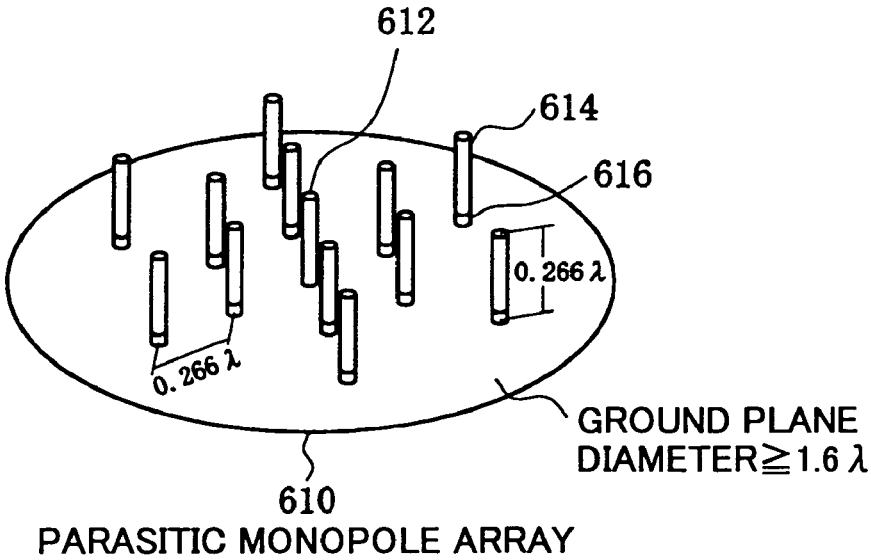

VARIABLE-DIRECTIVITY ANTENNA AND METHOD FOR CONTROLLING ANTENNA DIRECTIVITY

BACKGROUND OF THE INVENTION

1. Field of the Invention

The present invention generally relates to a radiation pattern varying technique for antennas, and more particularly to a variable-directivity antenna with a variable radiation pattern, which is made as small as an ordinary omnidirectional antenna and applicable to various types of information technology equipment, such as cellular phones and data processing devices. The present invention also relates to a method for controlling antenna directivity.

2. Description of Related Art

Along with the drastic advancement in radio communications technology, articles and products making use of wireless technologies have become popular, and great expansion of radio channel capacity is now expected. Especially, many studies have been made to increase the transmission capacity of a radio path by carrying out signal multiplexing over multiple dimensions, including time, space, polarized wave, and code.

Spatial multiplexing is realized by an adaptive array antenna constituted by a plurality of omnidirectional antennas and a vector composition circuit for synthesizing the signals. However, applications of such adaptive array antennas are limited because of size constraint on the adaptive arrays, in which each antenna element has a particular size and a certain space is required between antenna elements. For practical purposes, it is desired for an antenna to be as small as possible so as to be applied to mobile communication terminals.

In general, it is preferable to use a directional antenna with a variable radiation pattern (referred to as a "variable-directivity antenna"), rather than using an adaptive array antenna, in order to reduce the antenna size because a directional antenna uses only a set of antenna elements and a feeder circuit to vary the radiation pattern. Accordingly, the variable-directivity antenna is expected to be a candidate for small size antennas that realize spatial multiplexing. However, not many studies have been made so far for reducing the size of a variable-directivity antenna so far, and development of a miniaturized variable-directivity antenna is desired.

Some examples of a variable-directivity antenna are described in publications. For example, JPA 06-350334 disclosed an antenna device that can change the directivity by mechanically adjusting the positional relation between the antenna element and a reflecting element.

FIG. 1A illustrates the antenna device disclosed in JPA 06-350334, in which a reflecting element 511 is set parallel to the antenna element (or a radiator) 510 attached to a conductive member (such as an auto body). The reflecting element 511 is driven around the antenna element 510 by means of the radiation pattern control means 512, which is comprised of a rotating unit 512*a* and a coupling arm 512*b*. The antenna element 510 is electrically connected to a power source 515 via a feeder line or a coaxial cable 514.

By changing the rotating angle of the reflecting element 511, the directivity or the radiation pattern of the antenna can be varied. However, the arrangement of reflecting element 511 rotating around the antenna element 510 causes the size of the antenna device to increase.

FIG. 1B illustrates another example of a conventional variable-directivity antenna, as disclosed in JPA 10-154911, which is capable of electrically switching the directivity. The antenna device disclosed in this publication has a center radiation element 612 placed at the center of a round-shaped outer conductor 610 and a plurality of parasitic elements 614 surrounding the center radiation element 612. At the bottom of each parasitic element 614 is provided impedance load 616 for switching the impedance between high and low. The directivity of the antenna is changed by switching the impedance level of the impedance loads 616. The distance between the center radiation element 612 and the parasitic element 614 is about a quarter wavelength ($\lambda/4$), and therefore, the antenna size becomes greater than about $1.6\lambda$.

FIG. 1C illustrates still another example of a conventional variable-directivity antenna, which is disclosed in JPA 2001-24431. The variable-directivity antenna disclosed in this publication has an antenna element A0, to which a radio signal is fed, and variable reactance elements A1–A6 surrounding the antenna element A0, to which radio signal are not fed. These antenna elements A0–A6 are arranged on a round-shaped outer conductor 700. The distance "d" between the antenna element A0 and the variable reactance elements is about $\lambda/4$, and the size of the entire antenna device becomes about $\lambda$.

With the conventional variable-directivity antennas described above, the antenna size inevitably becomes large, as compared with omnidirectional antennas, and accordingly, it is difficult for them to be assembled into compact size information technology equipment, such as cellular phones or portable data processing terminals. This drawback limits applications of variable-directivity antennas.

Especially when the operating frequency is at or below several GHz, the wavelength becomes 10 cm or more, and even a slight change in size affects the handiness of equipment. Due to this drawback, the conventional variable-directivity antennas cannot be applied to mobile communication terminals.

SUMMARY OF THE INVENTION

Therefore, it is an object of the present invention to solve the above-described problem, and to provide a variable-directivity antenna with a size as small as an omnidirectional antenna and capable of varying the radiation pattern in a simple manner.

It is another object of the invention to provide a method for controlling the directivity of an antenna, without increasing the equivalent synthetic aperture of the antenna.

To achieve the object, electric field distribution of the feeder of an antenna is controlled or changed so as to vary the radiation pattern of the antenna.

To be more precise, in one aspect of the invention, a variable-directivity antenna comprises an omnidirectional antenna element, a transmission line connected to the antenna element, and an electric field adjusting structure provided in the boundary region between the antenna element and the transmission line and configured to change the electric field distribution of the transmission line toward a desired direction.

This arrangement can realize a variable-directivity antenna designed as small as an omnidirectional antenna.

In another aspect of the invention, a method for controlling the directivity of an antenna is provided. This method comprises the steps of feeding a radio signal through a transmission line of the antenna, and varying the electric field distribution of the transmission line in a boundary region between the transmission line and an antenna element connected to the transmission line such that the electric field distribution turns to a desired direction.

With this method, the directivity of the antenna can be controlled to a desired direction, without increasing the equivalent synthetic aperture of the antenna.

BRIEF DESCRIPTION OF THE DRAWINGS

Other objects, features, and advantages of the present invention will become more apparent from the following detailed description when read in conjunction with the accompanying drawings, in which:

FIG. 1A through FIG. 1C show conventional variable-directivity antennas;

DETAILED DESCRIPTION OF THE PREFERRED EMBODIMENT

Figure 1C:
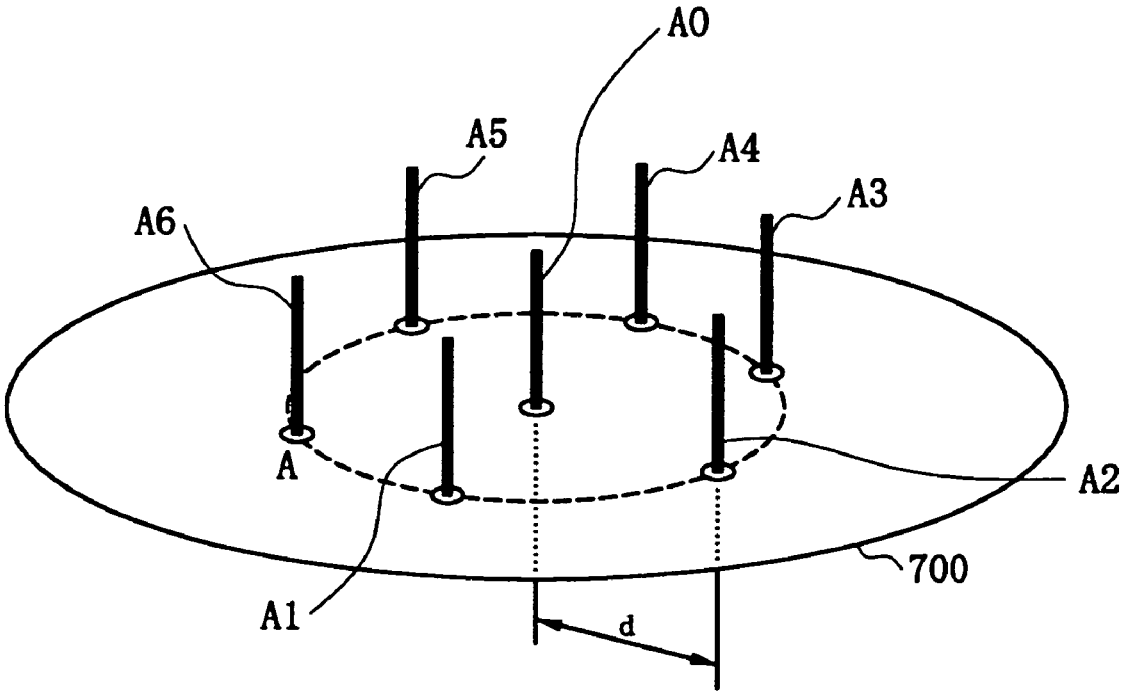
FIG.1C PRIOR ART

The preferred embodiments of the present invention are explained below in conjunction with attached drawings. First, the basic idea of the present invention is explained before actual examples of the variable-directivity antenna are described.

The conventional variable-directivity antenna has a radiator and parasitic elements arranged around the radiator, and the directivity of the antenna is controlled making use of the electromagnetic coupling between the radiator and the non-feeder elements. Since the equivalent synthetic aperture is increased with the conventional technique, the gain increases and the directivity of the antenna can be controlled. However, it is difficult for the conventional techniques to reduce the antenna size to an extent as small as an omnidirectional antenna, due to the operating principle and the antenna structure.

Unlike the conventional technique, according to the present invention, the radiation pattern or the directivity of the antenna is varied, without increasing the equivalent synthetic aperture of the antenna, by controlling the electric field distribution of the feeder connected to an omnidirectional antenna element.

In general, a transmission line is used to feed a radio signal to and from an omnidirectional antenna element, and the electric field distribution of the feeder is uniform or stationary in the transmission line. Even if the electric field distribution of the transmission line is changed from the stationary state by some method, the electric field distribution immediately returns to the uniform state as it propagates through the transmission line. However, if the electric field distribution is changed in the boundary region between the omnidirectional antenna element and the transmission line, radio signals with a non-uniform electric field distribution pattern can be transmitted from the antenna element (or the radiator) before the electric field distribution returns to the uniform state.

This concept applies not only to the transmission mode, but also to the receiving mode because the phenomenon is derived from coupling of the higher-order mode of the transmission line that forms a non-uniform electric field distribution with the propagation mode of the antenna via the electric field changing means arranged in the boundary region.

To implement this concept, a variable-directivity antenna comprises an omnidirectional antenna element, a transmission line connected to the omnidirectional antenna element, and an electric field adjusting structure provided in a boundary region between the antenna element and the transmission line and configured to change the electric field distribution of the transmission line to a desired direction. This arrangement allows the antenna to be formed as small as an omnidirectinal antenna.

The electric field adjusting structure is not necessarily positioned exactly at the boundary or in the connecting plane between the antenna element and the transmission line, but is positioned in the boundary region, in which unnecessary resonance does not occur, as long as degradation of the antenna characteristics due to resonance is prevented.

By defining the boundary region with respect to the connecting plane between the antenna element and the transmission line so as to avoid occurrence of resonance at the operating frequency of the antenna, a variable-directivity antenna as small as an omnidirectional antenna can be achieved without causing undesirable resonance.

Next, explanation is made of the preferred embodiments of the present invention.

First Embodiment

Figure 2A:
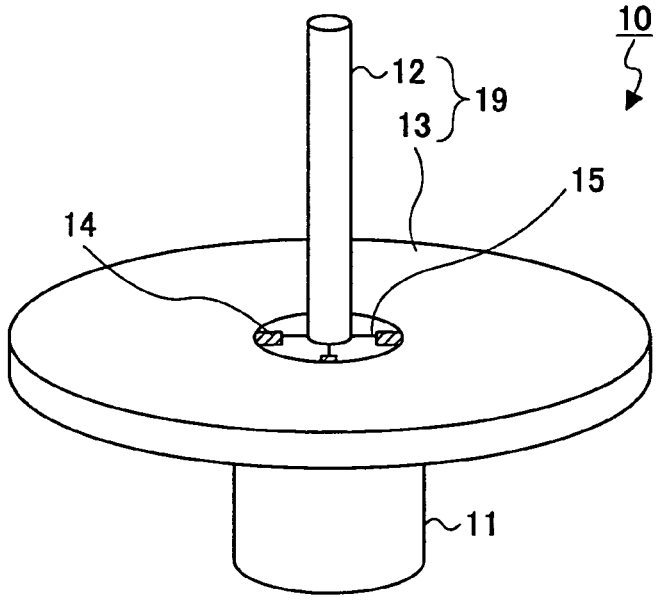
FIG. 2A and FIG. 2B illustrate a variable-directivity antenna using electrical switching means for changing electric field distribution of the feeder according to the first embodiment of the invention.
Figure 2B:
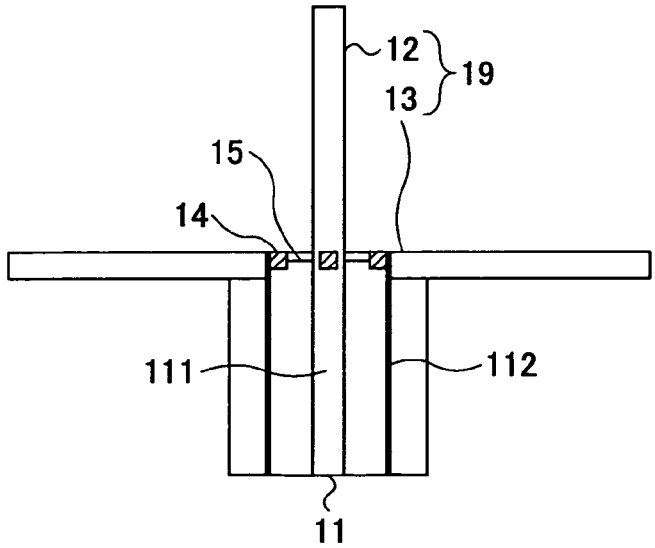

FIG. 2A is a perspective view of a variable-directivity antenna according to the first embodiment of the invention, and FIG. 2B is a cross-sectional view of the variable-directivity antenna shown in FIG. 2A.

The variable-directivity antenna 10 of the first embodiment employs a coaxial transmission line 11 and a monopole antenna (i.e., an antenna element) 19 connected to the coaxial transmission line 11. The coaxial transmission line 11 includes a center conductor 111 and an outer conductor 112. The monopole antenna 19 includes a radiator 12 and a ground plane 13, and is connected to the coaxial transmission line 11. Switches 14 and short-circuiting wires 15 are arranged at four positions around the radiator 12 (or the antenna element) in the connecting plane between the coaxial transmission line 11 and the monopole antenna 19. The switches 14 and the short-circuiting wires 15 form an electric field adjusting structure or electric field changing means to vary the electric field distribution of the coaxial transmission line 11.

The switches 14 are electrically ON/OFF controlled, and MicroElectroMechanical systems (MEMS) switches, diode switches, and other suitable switches can be employed as the switches 14. Since the short-circuiting wires 15 are arranged in the connecting plane between the monopole antenna 19 and the coaxial transmission line 11, no resonance occurs between the connecting plane and the short-circuiting wires 15 at any operating frequency. The short-circuiting wires 15 and/or the switches 14 may be arranged in a boundary region in the vicinity of the connecting plane between the monopole antenna 19 and the coaxial transmission line 11 as long as resonance does not occur at the operating frequency. To this end, the boundary region is defined with respect to the connecting plane so as to avoid occurrence of resonance at the operating frequency.

In the example shown in FIG. 2A and FIG. 2B, PIN diodes are used as the switches 14, which are externally controlled between the electrically ON state and the OFF state using a control electrode (not shown). When all of the switches 14 are turned off, there is no disturbance in the electric field distribution of the coaxial transmission line 11, and therefore, the radiation pattern of the antenna is omnidirectional. On the other hand, if at least one of the switches 14 is turned on, the electric field distribution of the coaxial transmission line 11 is disturbed, and the radiation pattern of the antenna becomes directional. By selecting the switch to be turned on, directivity of the antenna can be switched.

It should be noted that the short-circuited portion is sufficiently small as compared with the area between the center conductor 111 and the outer conductor 112. If the short-circuited portion is not sufficiently small, reflection at the short-circuited portion becomes large and the radiation efficiency of the antenna is degraded.

As is clearly shown, the variable-directivity antenna 10 of the first embodiment can be made as small as an ordinary omnidirectional antenna, and the directivity or the direction of the radiation peak can be changed easily by switch control.

Figure 3:
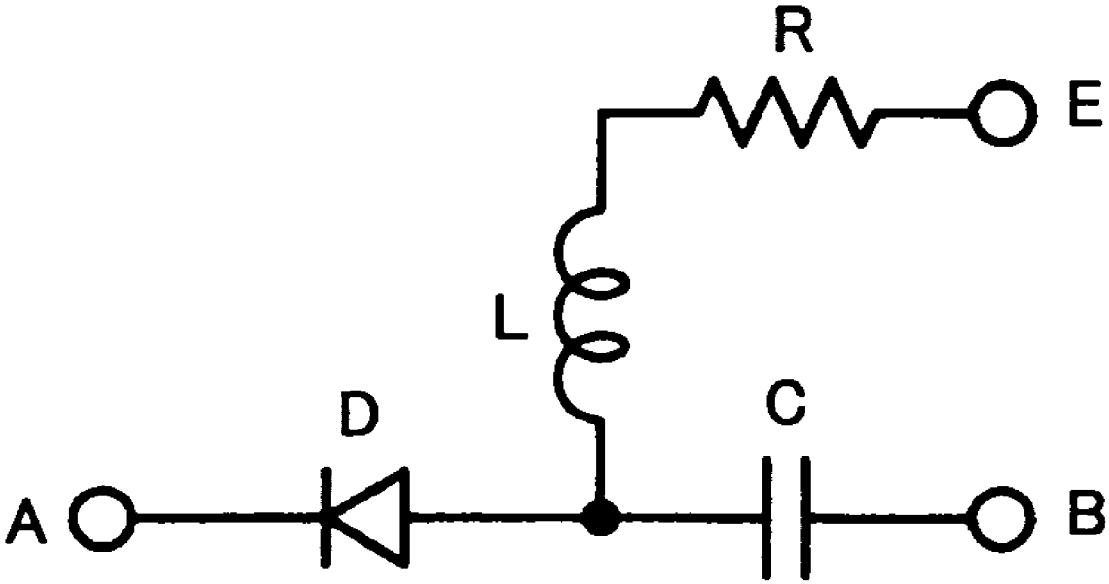
FIG. 3 is a circuit diagram of the switch used in the variable-directivity antenna shown in FIG. 2.

FIG. 3 illustrates an example of the switch 14, which includes terminals A, B, and E, a PIN diode D, capacitor C, inductor L, and resistor R. The terminal A is connected to the center conductor 111 of the coaxial transmission line 11, while the terminal B is connected to the outer conductor 112. The PIN diode D is grounded by the capacitor C at radio frequencies. By changing the DC bias applied to the terminal E, the resistance of the PIN diode D is changed greatly, and it functions as a switch.

Figure 4A:
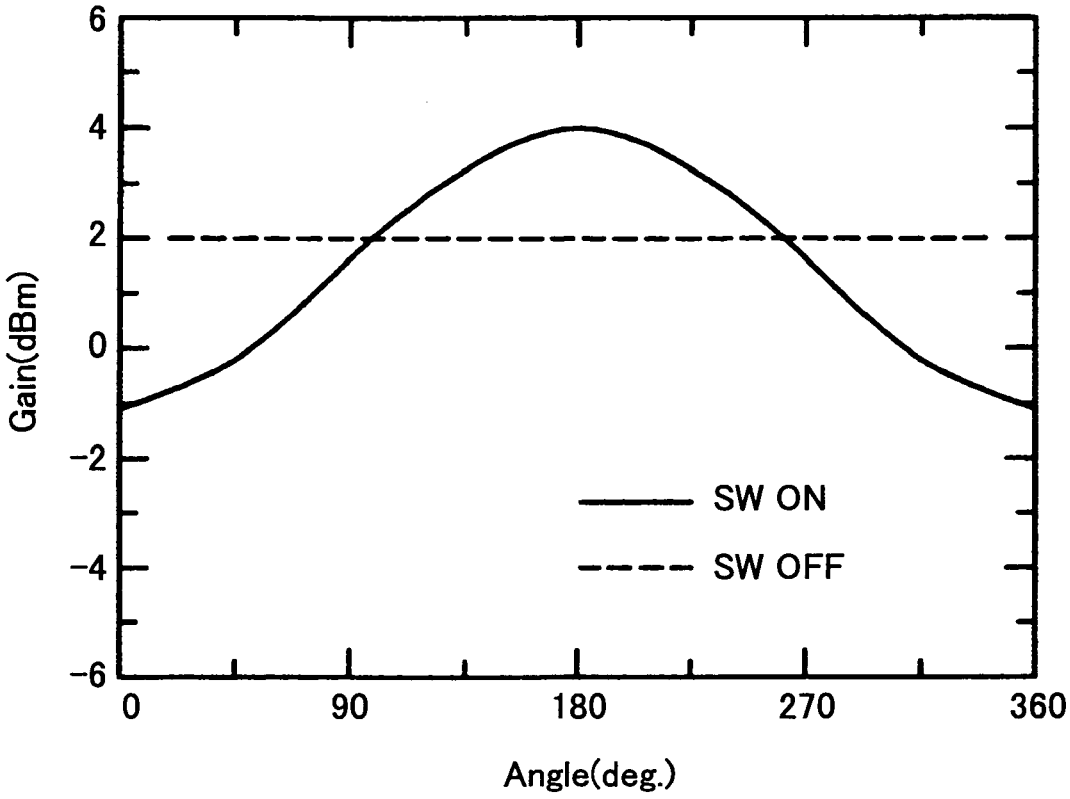
FIG. 4A and FIG. 4B are graphs for explaining the directivity of the variable-directivity antenna controlled by ON/OFF control of the switch.

FIG. 4A is a graph showing the directivity of the variable-directivity antenna according to the first embodiment. A turned-on switch 14 is located at a reference position (at 0 degrees), and the antenna gain at elevation angle 45 degrees from the ground plane 13 is plotted as a function of surrounding angles (from 0 to 360 degrees).

The solid line indicates the gain when the switch 14 position at 0 degrees is turned on, and the dashed line indicates the gain when all the switches 14 are turned off. As is clear from the graph, the antenna gain becomes constant with all the switches 14 turned off, and the antenna is omnidirectional. By turning on a switch, directivity is generated, and the radiation peak turns to a direction opposite to (i.e., 180 degrees from) the turned-on switch.

Figure 4B:
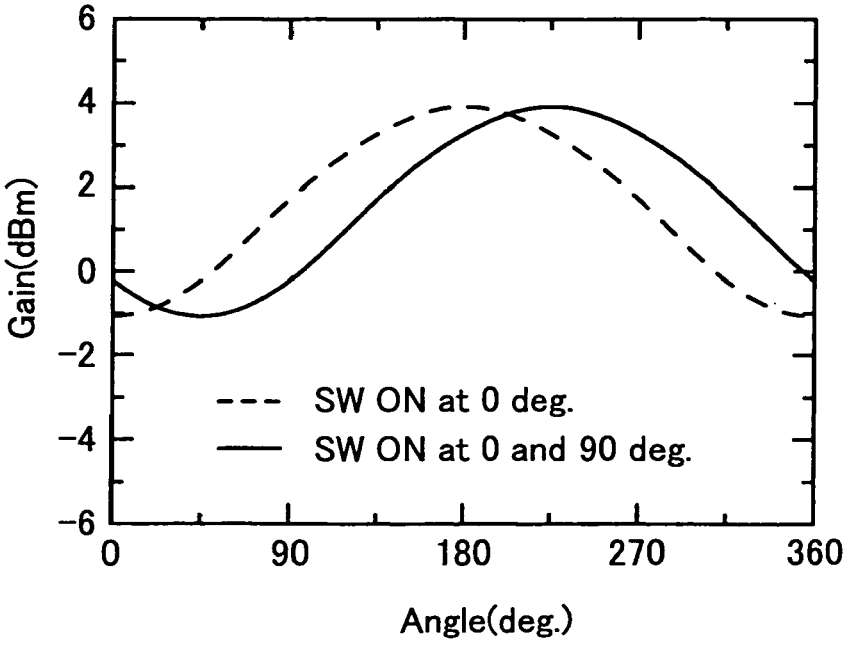

FIG. 4B is a graph showing a change in directivity when an adjacent switch positioned at 90 degrees is turned on, in addition to the first switch positioned at 0 degrees (shown in FIG. 4A). The dashed line indicates the antenna directivity with the peak at 180 degrees when the switch at 0 degree is turned on as illustrated in FIG. 4A. The solid line indicates the antenna directivity when two adjacent switches (at 0 degrees and 90 degrees in this example) are turned on. As indicated by the solid line, the radiation intensity peak appears at 225 degrees, which is 180 degrees from the 45-degree position in the middle of the two adjacent ON switches. This effect shows the superiority of the antenna structure of the first embodiment because antenna directivity can be controlled more flexibly and in more increments than the number of switches.

With the variable-directivity antenna of the first embodiment, the electric field distribution of the coaxial transmission line 11 is electrically controlled in a flexible manner simply by causing short-circuit at a selecting position between center conductor 111 and the outer conductor 112 of the coaxial transmission line 11. By using PIN diodes or MEMS switches, antenna directivity can be switched at a high rate based on the switching operation at the short-circuiting positions. In addition, omnidirectionality can be stored at any time simply by opening all the switches.

Second Embodiment

Figure 5A:
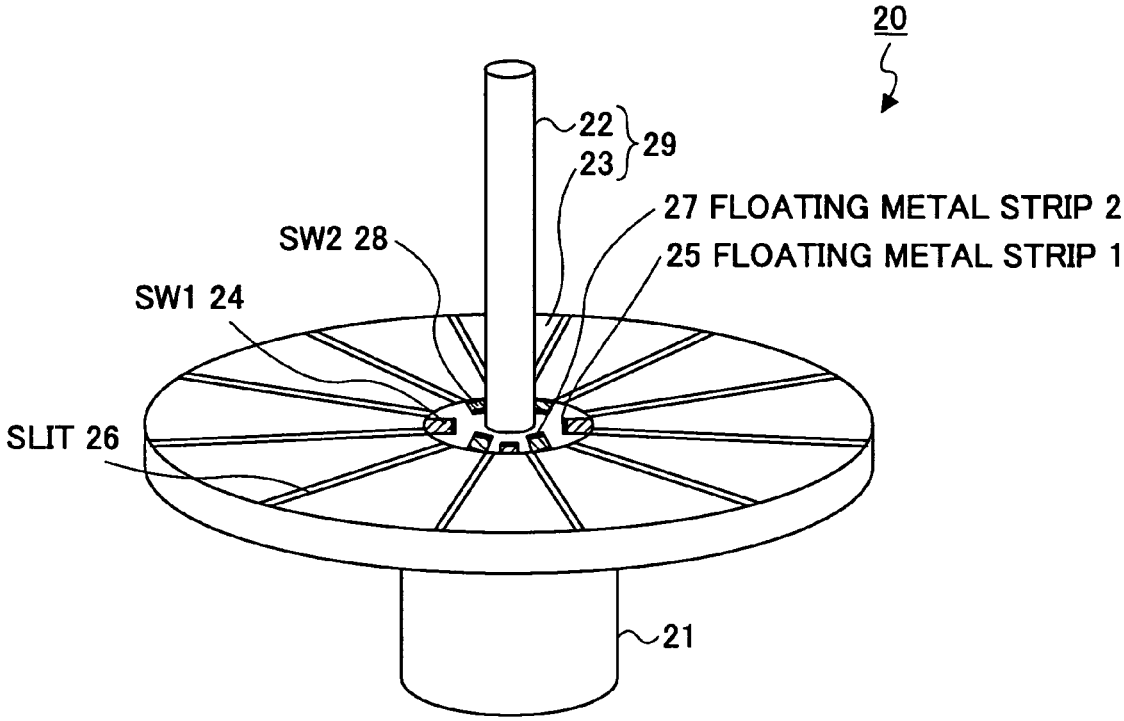
FIG. 5A through FIG. 5C illustrate a variable-directivity antenna according to the second embodiment of the invention.
Figure 5B:
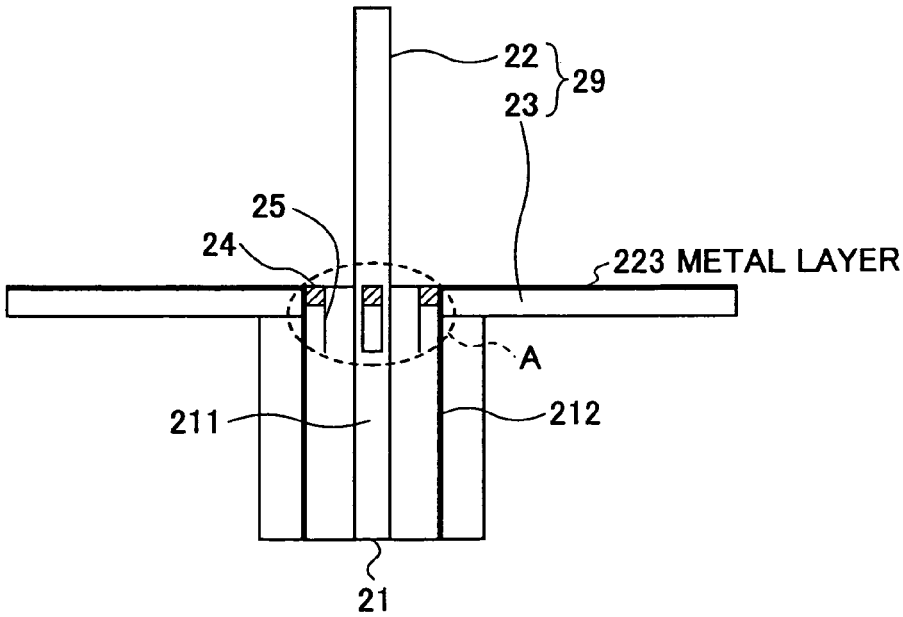
Figure 5C:
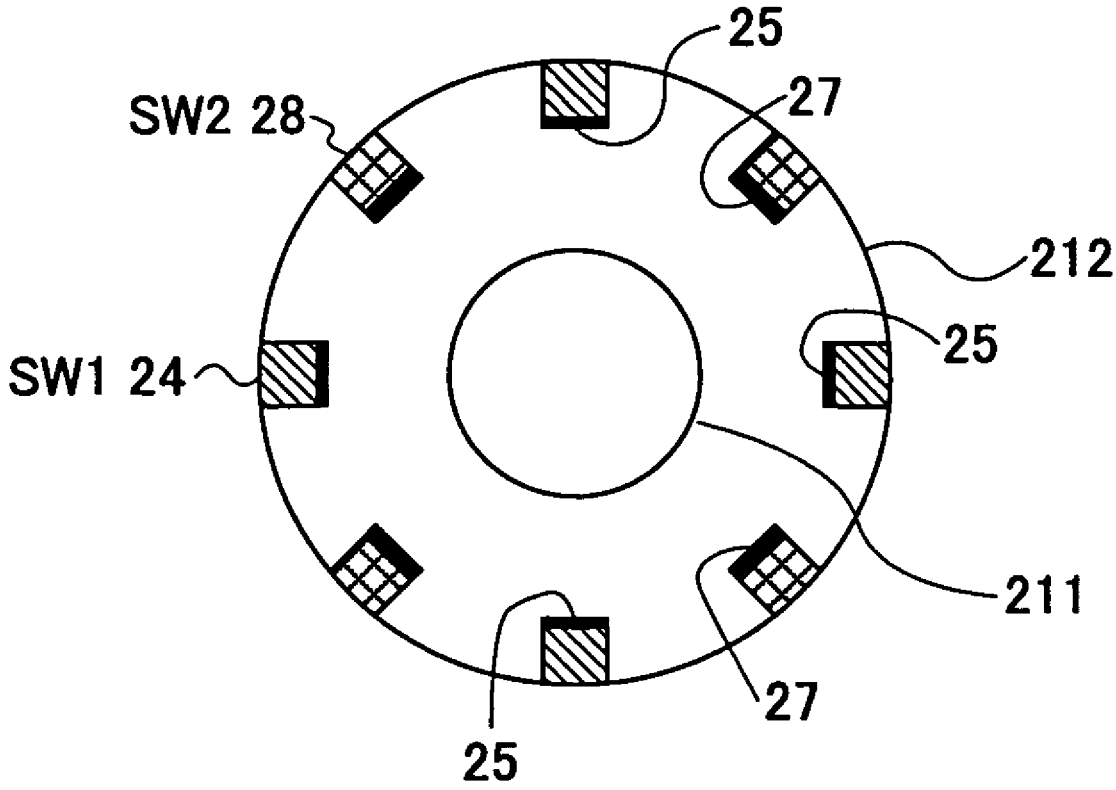

FIG. 5A through FIG. 5C illustrate a variable-directivity antenna 20 according to the second embodiment of the invention. In the second embodiment, slits or grooves extending in the radial direction are formed in the antenna element, and floating metal strips are used in the electric field changing means (or the electric field adjusting structure).

FIG. 5A is a perspective view and FIG. 5B is a cross-sectional view of the variable-directivity antenna 20, and FIG. 5C is a top view of the electric field adjusting structure according to the second embodiment.

A coaxial transmission line 21 is connected to a monopole antenna 29, which is comprised of a radiator 22 and a ground plane 23. The ground plane 23 comprises a metal layer 223 and a dielectric board (not shown) covered with the metal layer 223. Slits 26 are formed in the metal layer 223 so as to extend in the radial direction from the center and to electrically divide the surface area of the ground plane 23 into multiple sections.

First floating metal strips 25 with a first length and second floating metal strips 27 with a second length are arranged alternately around the radiator 22 in the boundary region A between the coaxial transmission line 21 and the monopole antenna 29. The first floating metal strips 25 and the second floating metal strips 27 extend parallel to the center conductor 211 and the outer conductor 212. The first floating metal strips 25 are connected to the outer conductor 212 via first switches 24, and the second floating metal strips 27 are connected to the outer conductor 212 via second switches 28.

FIG. 5C shows the switches 24 and 28, and the associated floating metal strips 25 and 27 arranged in the circumferential direction of the transmission line 21. In the second embodiment, the first length of the floating metal strip 25 is 0.8 mm, and the second length of the second floating metal strip 27 is 1.2 mm. The 0.8 mm floating metal strip 25 can vary the electric field distribution at an operating frequency of 25 GHz. The 1.2 mm floating metal strip 27 can vary the electric field distribution at an operating frequency of 19 GHz. The switches 24 and 28 are MEMS switches, each of which is externally ON/OFF controlled using control electrodes (not shown). The switches 24 and 28 and the floating metal strips 25 and 27 form electric field changing means or an electric field adjusting structure.

If all of the switches 24 and 28 are turned off, no disturbance is generated in the electric field distribution of the coaxial transmission line 21, and the radiation pattern of the antenna 20 is omnidirectional.

When one of the first switches 24 is turned on, the electric field distribution is changed at 25 GHz so as to turn the peak in a desired direction. That is, the 25-GHz radiation pattern becomes directional. When one of the second switches 28 is turned on, the electric field distribution is changed at 19 GHz, and the 19-GHz radiation pattern becomes directional showing the peak turned in a desired direction. By separately controlling the first switches 24 and the second switches 28, the antenna directivity can be controlled at multiple frequencies.

A desired switch can be selected and turned on to switch the direction of the radiation pattern at a desired operating frequency. The changed electric field distribution can be maintained during radiation by means of the slits 26. The effect of the slits 26 is explained below.

As has been described in the first embodiment, the electric field distribution is controlled in the boundary region between the antenna element (monopole antenna 19) and the transmission line 11 without causing resonance. However, the non-uniform distribution of the electric field may return to the uniform or static state during the radiation, depending on the antenna shape. To avoid this, a gap (such as a slit or a groove) extending in the radial direction is formed in the conductive layer of the antenna element (e.g., the monopole antenna 29). The radial gap prevents an electric current path generated on the antenna surface when the non-uniform electric field distribution tries to return to the uniform state, from expanding in the radial direction. Consequently, a radio signal or electromagnetic wave is radiated from the antenna element, while maintaining the controlled pattern of the electric field distribution.

This arrangement realize a variable-directivity antenna as small as an omnidirectional antenna and capable of maintaining a non-uniform electric field distribution pattern during radiation.

In this manner, the electric field distribution is varied by inserting floating metal strips 25 and 27 between the center conductor 211 and the outer conductor 212 of the transmission line 21, and by causing short-circuit between the outer conductor 212 and a portion of a floating metal strip using a switch (such as a PIN diode or a MEMS switch). Preferably, a tip of the selected floating metal strip in the signal propagation direction is short-circuited to the outer conductor 212. Electrical switching allows high-speed switching of the short-circuited portion, and the directivity of the antenna can be controlled at a high rate. When the short-circuit is released, the antenna becomes omnidirectional.

With a floating metal strip, the electric field distribution varies only at an operating frequency depending on the length of the metal strip. By using floating metal strips with different lengths and controlling them separately, antenna directivity can be controlled independently at each operating frequency corresponding to one of the lengths of floating metal strips.

To evenly arrange different lengths of floating metal strips, the floating metal strips with different lengths are positioned alternately along the circumference of the antenna element. This arrangement allows the electric field distribution of the transmission line to vary toward various directions while keeping the distribution pattern during radiation, at each of the operating frequencies.

Although in the second embodiment, different lengths of floating metal strips 25 and 27 are arranged around the radiator 22 in combination with the radially extending slits 26, floating metal strips with a single length may be combined with the slit structure. In this case, the variable-directivity antenna works at a single operating frequency. To make the variable-directivity antenna work at different operating frequencies, a variable capacitor may be provided to the floating metal strip. The variable capacitor varies the electrical length of the floating metal strip. By varying the capacitance, the variable-directivity antenna can function at different operating frequencies.

Third Embodiment

Figure 6A:
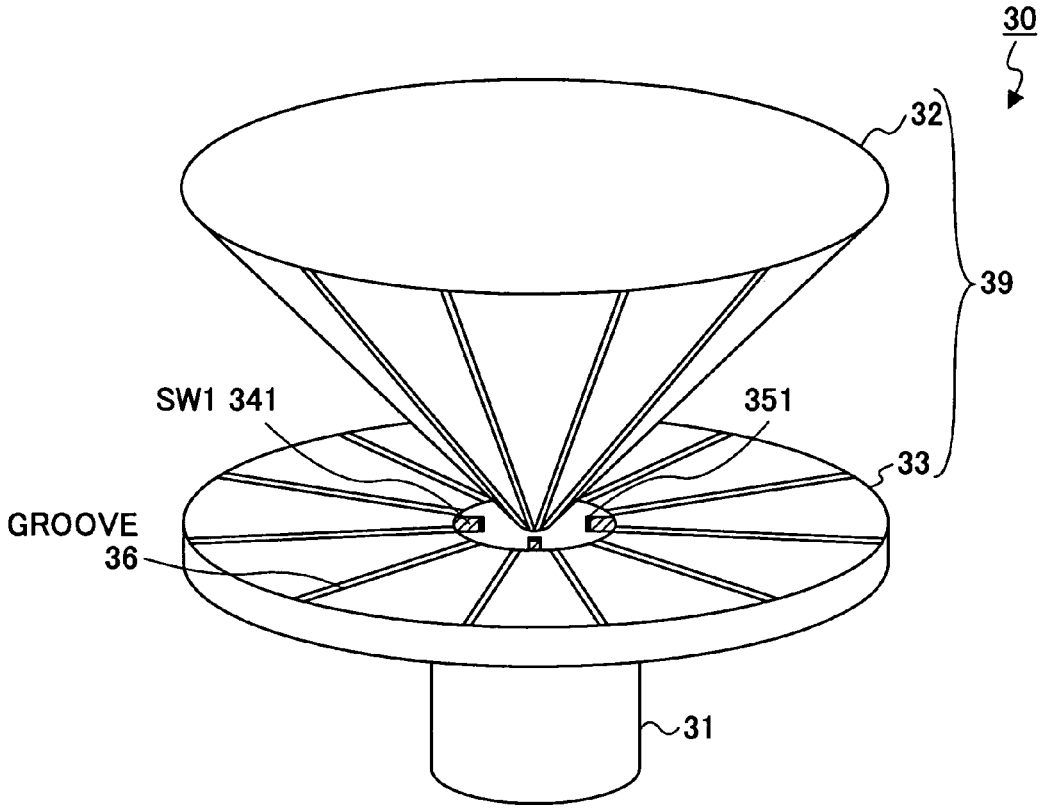
FIG. 6A and FIG. 6B illustrate a variable-directivity antenna according to the third embodiment of the invention.
Figure 6B:
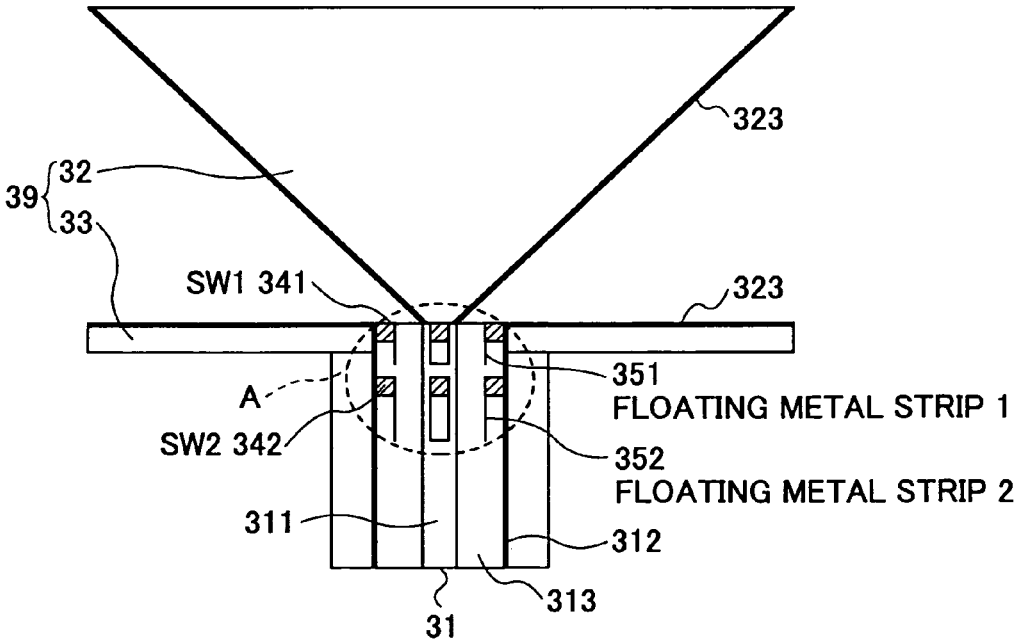

FIG. 6A and FIG. 6B illustrate a variable-directivity antenna 30 according to the third embodiment of the invention. In the third embodiment, a discone antenna with radially extending grooves is employed as the omnidirectional antenna element, and two circles of floating metal strips with different lengths are arranged at different positions along the longitudinal axis of the transmission line.

FIG. 6A is a perspective view and FIG. 6B is a cross-sectional view of a variable-directivity antenna 30. The variable-directivity antenna 30 includes a discone antenna 39 comprising a cone-shaped top electrode 32 and a ground plane 33, and a coaxial transmission line 31 connected to the discone antenna 39. A discone antenna is a traveling wave type antenna suitable for wide band communications.

Radially extending grooves 36 are formed in the metal layer 323 of the top electrode 32 and the ground plane 33. The coaxial transmission line 31 includes a center conductor 311, an outer conductor 312, and a dielectric material 313 filling the space between the center conductor 311 and the outer conductor 312.

First floating metal strips 351 with a first length are buried in the dielectric material 313 at a first position along the coaxial transmission line 31. Second floating metal strips 352 with a second length are buried in the dielectric material 313 at a second position along the coaxial transmission line 31. The first floating metal strips 351 are connected to the outer conductor 312 via first switches 341, and the second floating metal strips 352 are connected to the outer conductor 312 via second switches 342. The first and second floating metal strips 351 and 352 and the first and second switches 341 and 342 are arranged in the boundary region A between the discone antenna 39 and the coaxial transmission line 31, and constitute an electric field distribution adjusting structure. The boundary regions A is defined so as not to cause resonance at the operating frequencies.

In the example shown in FIGS. 6A and 6B, four first floating metal strips 351 and four second floating metal strips 352 are arranged at the same circumferential angles around the discone antenna 39, but at different positions in the longitudinal direction. The dielectric constant of the dielectric material 313 is 2.3, the first length of the first floating metal strips 351 is 0.8 mm, and the second length of the second floating metal strips 352 is 1.2 mm. The electric field distribution of the coaxial transmission line 31 is varied at operating frequencies of 25 GHz and 19 GHz.

The first and second switches 341 and 342 are PIN diode switches, and the ON/OFF states of the switches are electrically controlled using control electrodes (not shown) outsides the antenna 30. If all the switches 341 and 342 are turned off, there is no disturbance in the electric field distribution of the coaxial transmission line 11, and the radiation pattern of the antenna 30 becomes omnidirectional.

When one of the first switches 341 is turned on, the uniform and static state of the electric field distribution of the coaxial transmission line 31 is disturbed by 25-GHz signals, and the 25-GHz radiation pattern has directivity. When one of the second switches 342 is turned on, the uniform and static state of the electric field distribution of the coaxial transmission line 31 is disturbed by 19-GHz signals, and the 19-GHz radiation pattern has directivity. By selecting a switch to be turned on, the direction of the radiation pattern can also be switched at a desired operating frequency.

In the third embodiment, the direction of directivity control of the antenna 30 is the same at both operating frequencies of 25 GHz and 19 GHz because the first line of floating metal strips 351 and the second line of floating metal strips 352 are arranged at same circumferential angles. Accordingly, the directivity of the antenna 30 can be switched quickly at different operating frequencies, but to the same short-circuiting directions. The entire antenna size is as small as an ordinary omnidirectional antenna. In addition, the controlled radiation pattern (or electric field distribution pattern) can be maintained during radiation by the grooves formed in the top electrode 32 and the ground plane 33.

Fourth Embodiment

FIG. 7A through FIG. 7D illustrate a variable-directivity antenna 40 according to the fourth embodiment of the invention. In the fourth embodiment, a biconical antenna with grooves formed in the surface area is employed as the omnidirectional antenna element, and electric field distribution is varied by changing the permittivity of the dielectric material of the transmission line in the boundary region A between the antenna element and the transmission line.

Figure 7A:
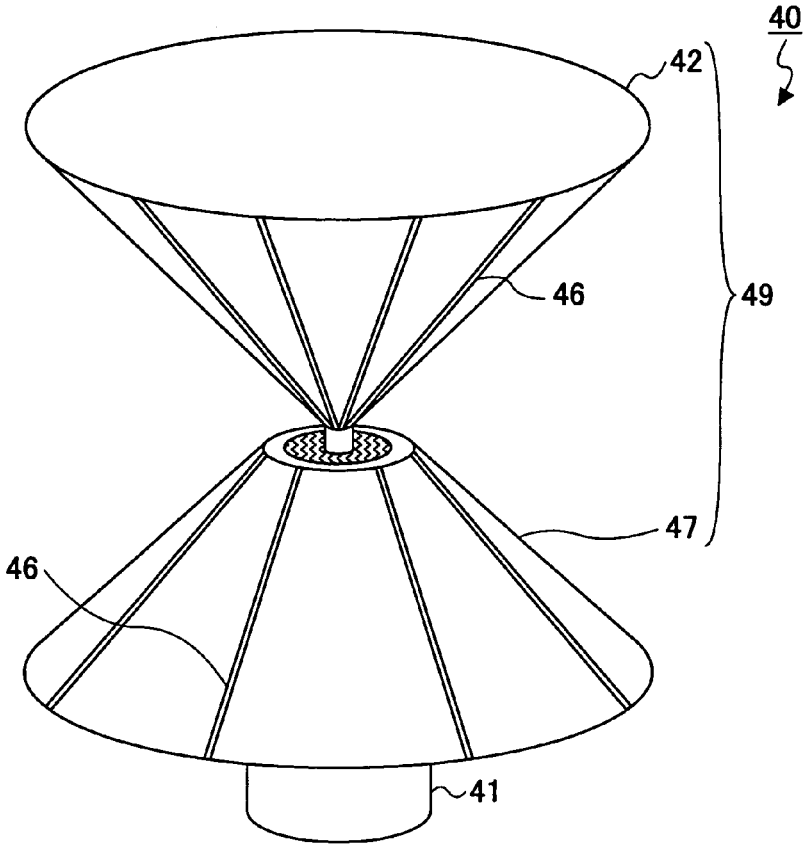
FIG. 7A through FIG. 7D illustrate a variable-directivity antenna according to the fourth embodiment of the invention.
Figure 7B:
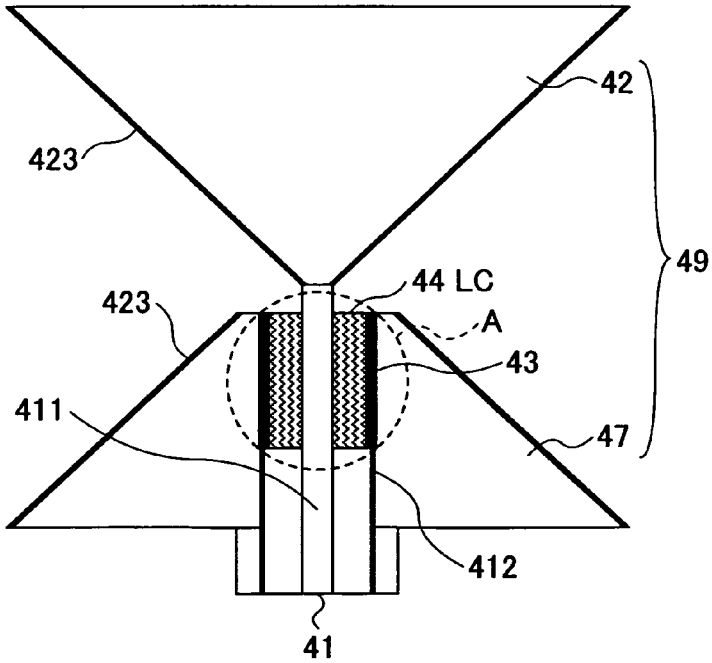

FIG. 7A is a perspective view and FIG. 7B is a cross-sectional view of the variable-directivity antenna 40. The variable-directivity antenna 40 includes a biconical antenna 49 comprising a top electrode 42 and a bottom electrode 47, and a coaxial transmission line 41 connected to the biconical antenna 49. A biconical antenna is a traveling wave type antenna suitable for wide band communications, and has a simple structure fabricated at a low cost.

Radially extending grooves 46 are formed in the metal layer 423 of the top electrode 42 and the bottom electrode 47. The coaxial transmission line 41 includes a center conductor 411, an outer conductor 412, and liquid crystal layer 44 filling the space between the center conductor 411 and the outer conductor 412 at least in the boundary region A between the biconical antenna 49 and the coaxial transmission line 41. A control electrode 43 is provided in the boundary region A so as to change the permittivity (dielectric constant) of a desired portion of the liquid crystal layer 44. (External connection electrodes are not shown in the drawing.) If there is no change in permittivity of the liquid crystal, there is no disturbance in electric field distribution of the coaxial transmission line 41, and the antenna 40 is omnidirectinal. By changing the permittivity of a desired portion of the liquid crystal, electric field distribution is varied so as to have the peak toward a desired direction.

Figure 7C:
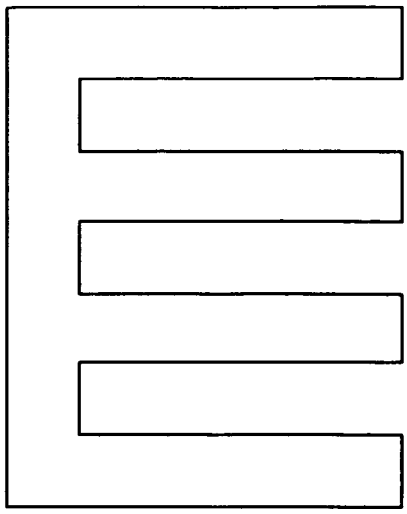
Figure 7D:
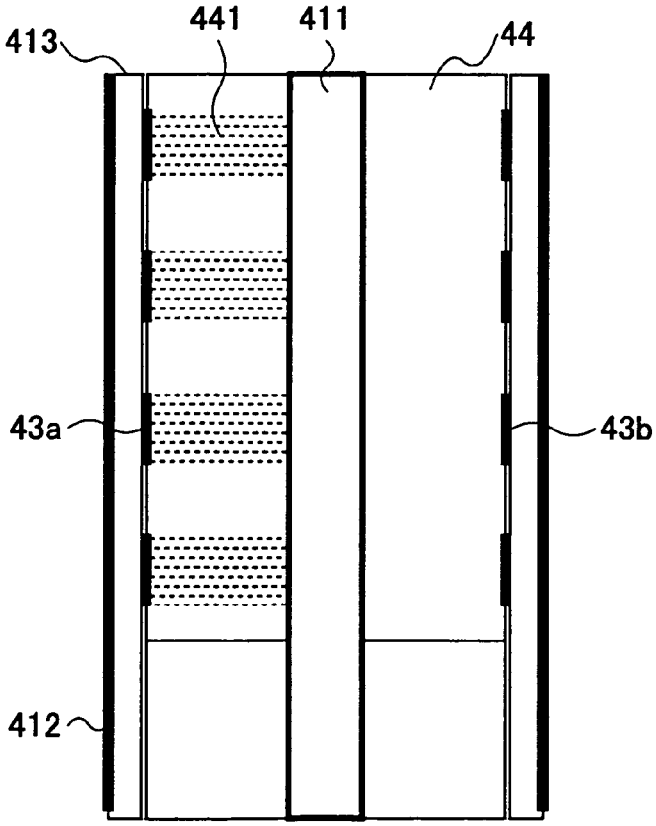

FIG. 7C shows an example of the control electrode 43, which is shaped as a comb electrode, and FIG. 7D is an enlarged view of the boundary region A in which comb electrodes 43*a* and 43*b* are arranged along the liquid crystal layer 44. An insulating layer 413 is provided between the outer conductor 412 and the comb electrodes 43*a* and 43*b*. In this example, four comb electrodes 43 are arranged along the liquid crystal layer 44 at 90-degree intervals around the center conductor 411 in circumferential symmetry. (Only two of them are shown in FIG. 7D.) The teeth of the comb electrodes 43 extend in a direction perpendicular to the longitudinal axis of the coaxial transmission line 41.

If a voltage is applied between the comb electrode 43*a* and the center conductor 411, the permittivity of the liquid crystal layer 44 changed only in the control zone 441, and therefore, periodic change is generated in the permittivity of the liquid crystal layer 44. In addition, the equivalent impedance of the coaxial transmission line 41 appears to have changed in periodic portions along the longitudinal axis of the transmission line 41, causing a change in electric distribution within the isophase plane. Consequently, the radiation pattern is changed toward a desired direction.

In this example, if a voltage is applied to the comb electrode 43*a*, the peak of the electric field distribution appears on the opposite side, away from the comb electrode 43*a* that causes the impedance change. By selecting a desired comb electrode to which a voltage is applied, the directivity of the antenna 40 can be switched to a desired direction. The controlled radiation pattern can be maintained during radiation or transmission of radio signals because of the grooves 46 formed on the surface of the biconical antenna 49.

In place of the comb electrodes 43, strip electrodes (not shown) may be arranged around the center conductor 411. In this case, when a voltage is applied between a selected one of the strip electrodes and the center conductor 411, the index refraction of the corresponding portion of the liquid crystal layer 44 is changed, and therefore, the permittivity changes. If the antenna 40 is designed so that the permittivity of the liquid crystal layer 44 is increased upon application of voltage, the peak of the radiation pattern appears on the side of the selected strip electrode to which the voltage is applied. The controlled radiation pattern can be maintained during radiation or transmission of radio signals because of the grooves 46.

In this manner, the variable-directivity antenna 40 can be made as small as an ordinary omnidirectional antenna, and the radiation pattern of the variable-directivity antenna 40 can be controlled by simple switching operations.

a) As has been described above, by employing an omnidirectional antenna and an electric field adjusting structure for changing the electric field distribution of the transmission line, a variable-directivity antenna made as small as an ordinary omnidirectinal antenna can be realized.

b) Since the electric field adjusting structure is placed in the boundary region, which is defined with respect to the connecting plane between the omnidirectional antenna element and the transmission line so as not to cause undesirable resonance at the operating frequency, a compact variable-directivity antenna that avoids unnecessary resonance can be achieved.

c) By forming radially extending gaps (e.g., slits or grooves) in the conductive area of the antenna element, the radiation pattern or the electric field distribution controlled by the electric field changing structure can be maintained during the radiation of signals.

d) By externally and electrically controlling the electric field distribution of the transmission line, a variable-directivity antenna as small as an omnidirectional antenna and capable of high-speed switching of directivity can be realized.

e) By using different lengths of floating metal strips in the electric field changing structure, the antenna directivity can be changed at a high rate at two or more operating frequencies independently.

Although the present invention has been described based on specific examples, the invention is not limited to these examples. Any combination of the first through fourth embodiments is also within the scope of the invention. For example, slits may be formed in the monopole antenna 19 of the first embodiment.

The number of switches or electrodes is not limited to four, and they may be arranged in arbitrary circumferential directions (generalized to n directions, where $n \geqq 2$). For example, they can be arranged in three directions, or five or more directions (such as eight directions) around the center conductor.

The dielectric material filling the space between the center conductor and the outer conductor is not limited to liquid crystal, and any suitable material can be used.

The transmission line is not limited to a coaxial transmission line, and a waveguide may be used. In the latter case, the electric field distribution of the waveguide is changed by the electric field adjusting structure.

This patent application is based on and claims the benefit of the earlier filing dates of Japanese Patent Application No. 2003-076953 filed Mar. 20, 2003, and Japanese Patent Application No. 2004-73701, filed Mar. 16, 2004, the entire contents of which are hereby incorporated by reference.

What is claimed is:

1. A variable-directivity antenna comprising:

an omnidirectional antenna element;

a transmission line connected to the antenna element; and an electric field adjusting structure provided in a boundary region between the antenna element and the transmission line and configured to change electric field distribution of the transmission line to a desired direction.

2. The variable-directivity antenna of claim 1, wherein the boundary region is an area defined with respect to a connecting plane between the antenna element and the transmission line so as to avoid occurrence of resonance at an operating frequency of the antenna.

3. The variable-directivity antenna of claim 1, wherein at least a surface area of the antenna element is made of a conductive material, and the antenna element has a gap formed in the conductive material and extending in the radial direction from a center of the antenna element.

4. The variable-directivity antenna of claim 1, wherein the electric field adjusting structure includes an electrical switch for changing the electric field distribution of the transmission line.

5. The variable-directivity antenna of claim 4, wherein the transmission line includes a center conductor connected to the antenna element and an outer conductor around the center conductor; and wherein the electric field adjusting structure includes two or more of the switches positioned in the boundary region, and at least one of the switches is used to cause short-circuit between the center conductor and the outer conductor at a predetermined position around the antenna element.

6. The variable-directivity antenna of claim 4, wherein the transmission line includes a center conductor connected to the antenna element and an outer conductor around the center conductor; and wherein the electric field adjusting structure includes a plurality of floating conductor strips inserted between the center conductor and the outer conductor and two or more of the switches arranged in the boundary region, at least one of the switches being used to cause short-circuit between at least one of the floating conductor strips and the outer conductor at a predetermined position around the antenna element.

7. The variable-directivity antenna of claim 6, wherein the floating conductor strips have different lengths and are arranged alternately around the antenna element.

8. The variable-directivity antenna of claim 6, wherein the floating conductor strips include a first group of floating conductor strips with a first length arranged in the boundary region at a first position along a longitudinal axis of the transmission line, and a second group of floating conductor strips with a second length arranged in the boundary region at a second position along the longitudinal axis of the transmission line.

9. The variable-directivity antenna of claim 6, wherein each of the floating conductor strips is furnished with a variable capacitor element.

10. The variable-directivity antenna of claim 4, wherein the transmission line includes a center conductor connected to the antenna element, an outer conductor around the center conductor, and a dielectric material filling a space between the center conductor and the outer conductor; and wherein the electric field adjusting structure includes two or more electrodes arranged at predetermined intervals around the center conductor, and a voltage is applied across at least one of the electrodes and the center conductor so as to vary a dielectric constant of the dielectric material at a predetermined position.

11. The variable-directivity antenna of claim 10, wherein the electrode is a comb electrode.

12. The variable-directivity antenna of claim 10, wherein the dielectric material is liquid crystal.

13. The variable-directivity antenna of claim 1, wherein the transmission line is a coaxial cable.

14. A method for controlling directivity of an antenna, the method comprising the steps of:

feeding a radio signal through a transmission line of the antenna; and varying electric field distribution of the transmission line in a boundary region between the transmission line and an antenna element connected to the transmission line, such that the electric field distribution turns to a desired direction.

15. The method of claim 14, further comprising the steps of:

defining the boundary region with respect to a connecting plane between the antenna element and the transmission line so as to avoid occurrence of resonance at an operating frequency of the antenna;

providing a plurality of switches in the boundary region; and causing a short-circuit between a center conductor and an outer conductor that form the transmission line using at least one of the switches at a predetermined position around the antenna element to turn the electric field distribution to a direction opposite to the short-circuited position.

16. The method of claim 14, further comprising the steps of:

providing a plurality of floating conductor strips between a center conductor and an outer conductor that form the transmission line;

providing a plurality of switches in the boundary region; and causing a short-circuit between at least one of the floating conductor strips and the outer conductor using at least one of the switches at a predetermined position so as to turn the electric field distribution to a direction opposite to the short-circuited position.

17. The method of claim 16, wherein the floating conductor strips with different lengths are prepared corresponding to different operation frequencies and are positioned around the center conductor in the boundary region, and the electric field distribution is turned to the desired direction at a selected operating frequency.

18. The method of claim 16, further comprising the steps of:

arranging a first set of the floating conductor strips with a first length in the boundary region at a first position along a longitudinal axis of the transmission line;

arranging a second set of the floating conductor strips with a second length in the boundary region at a second position along the longitudinal axis of the transmission line; and changing the electric field distribution of the transmission line by causing a short-circuit between a selected one of the floating conductor strips and the center conductor at one of first and second operating frequencies.

19. The method of claim 14, further comprising the steps of:

arranging a plurality of electrodes at predetermined intervals around the center conductor of the transmission line; and applying a voltage across at least one of the electrode and the center conductor to change a permittivity of a selected portion of a dielectric material filling a space between the center conductor and the outer conductor in order to turn the electric field distribution to the desired direction.

20. The method of claim 19, wherein the permittivity of the dielectric material is increased at the selected portion upon application of the voltage, and the electric field distribution is turned to a direction of the selected portion with the increased permittivity.

21. The method of claim 19, wherein the electrodes are comb electrodes, equivalent impedance of the selected portion of the dielectric material is changed upon application of the voltage, and the electric field distribution is turned to a direction opposite to the selected portion.

* * * * *